United States Patent [19]

Ueki et al.

[11] Patent Number: 4,605,327

[45] Date of Patent: Aug. 12, 1986

[54] PRINT RIBBON CASSETTE INCLUDING RIBBON TENSIONING MEANS

[75] Inventors: Junzo Ueki; Yoshiaki Nakajima, both of Kodaira, Japan

[73] Assignee: Silver Seiko Ltd., Japan

[21] Appl. No.: 758,055

[22] Filed: Jul. 23, 1985

[30] Foreign Application Priority Data

Jul. 31, 1984 [JP] Japan ..... 59-158584

[51] Int. Cl.[4] ..... B41J 32/00

[52] U.S. Cl. ..... 400/208; 400/228; 400/234

[58] Field of Search ..... 400/207, 208, 208.1, 400/228, 234; 242/198; 226/195, 189

[56] References Cited

U.S. PATENT DOCUMENTS

| | | | |
|---|---|---|---|
| 3,442,366 | 5/1969 | Spears | 400/234 |
| 4,010,839 | 3/1977 | Guerrini et al. | 400/207 |
| 4,074,799 | 2/1978 | Hishida et al. | 400/208 |
| 4,225,100 | 9/1980 | Sugawara | 242/198 |
| 4,232,840 | 11/1980 | Sugawara | 242/198 |
| 4,337,001 | 6/1982 | Cappotto | 400/208 |
| 4,368,992 | 1/1983 | Gagnebin | 400/234 X |
| 4,373,824 | 2/1983 | Olsen | 400/234 |
| 4,447,020 | 5/1984 | Toi et al. | 242/198 |
| 4,470,560 | 9/1984 | Yoneya et al. | 242/198 |
| 4,505,605 | 3/1985 | Hasegawa et al. | 400/208 |
| 4,523,868 | 6/1985 | Shadwick | 400/208 |
| 4,533,266 | 8/1985 | Saito et al. | 400/208 |

FOREIGN PATENT DOCUMENTS

| | | | |
|---|---|---|---|
| 0083926 | 7/1983 | European Pat. Off. | 400/234 |
| 3106252 | 10/1982 | Fed. Rep. of Germany | 400/208 |

OTHER PUBLICATIONS

*IBM Technical Disclosure Bulletin,* "Constant-Tension Ribbon Cartridge", Bullock et al, vol. 23, No. 5, Oct. 1980, pp. 1741-1742.

*Primary Examiner*—Ernest T. Wright, Jr.
*Attorney, Agent, or Firm*—Lane and Aitken

[57] ABSTRACT

A print ribbon cassette of a simplified construction which can prevent slackening of a print ribbon and normally keep the print ribbon in taut condition for printing. The print ribbon cassette comprises a lock member having a locking position for preventing inadvertent rotation of a feed spool on which a print ribbon to be supplied is wound. The cassette further comprises a ribbon lock control member which is moved between an operative position and an inoperative position in response to a tensile force of a print ribbon applied thereto. In the operative position of the ribbon lock control member, it engages with the lock member and holds the same to the lock position.

8 Claims, 3 Drawing Figures

PRINT RIBBON CASSETTE INCLUDING RIBBON TENSIONING MEANS

BACKGROUND OF THE INVENTION

This invention relates to a print ribbon cassette for use with a typewriter, printer or like printing office machines.

In a typical one of conventional print ribbon cassettes, a ribbon is wound on a flange supported for rotation in a cassette body and has a beginning end thereof secured to a take-up spool while a required length of the ribbon between the flange and the take-up spool is exposed outside the cassette body so as to be used for printing therewith with a tensile force applied to the ribbon to maintain the exposed portion of the ribbon in taut condition.

For example, a ribbon cartridge disclosed in Japanese laid-open patent No. 57-57687 has a ribbon lock device for causing a required tensile force to be applied to a printing portion of a ribbon, and the ribbon lock device includes a tension element on which ribbon is mounted, a brake blade, and a bellcrank connecting mechanism including a slot, an unlocking member and so on for interconnecting the tension element and the brake blade.

However, such a conventional ribbon cartridge has a drawback in that it includes a large number of parts in its ribbon lock device and is complicated in structure, and hence much time is required to assemble them, resulting in increase in production cost.

SUMMARY OF THE INVENTION

The present invention contemplates the provision of a print ribbon cassette which eliminates such drawbacks of a conventional print ribbon cassette as described above.

According to the invention, a print ribbon cassette includes a cassette body, a lock member mounted on the cassette body and having a locking position in which the lock member locks rotation of a feed spool on which a ribbon is wound and an unlocking or lock release position in which the lock member is released from the locking position, and a ribbon lock control member having an operative position for controlling the lock member between the locking position and the lock release position and an inoperative position and urged to the operative position by means of a spring member.

In the present invention, the ribbon lock control member and the lock member are caused to cooperate with each other by a balance between an urging force of the ribbon lock control member by the spring member and a tensile force of the ribbon such that rotation of the feed spool is locked by the lock member during disuse of the ribbon, that is, when a ribbon feed drive mechanism of a typewriter or printer is inoperative but when the ribbon feed drive mechanism operates, the ribbon lock control member is displaced from the operative position to the inoperative position to release the feed spool from locking by the lock member to allow rotation of the feed spool to feed the ribbon.

DETAILED DESCRIPTION OF THE PREFERRED EMBODIMENT

The drawings show a print ribbon cassette according to the present invention. The print ribbon cassette includes a cassette body 1 made of a synthetic resin material which has a generally rectangular bottom plate 2 and a side wall 3 extending from a periphery of the bottom plate 2 and is thus in the form of a flattened casing having an open top. A pair of guide portions **5*a* and 5*b* for guiding a print ribbon 4 extend from opposite corners of the cassette body 1**.

Figure 3:
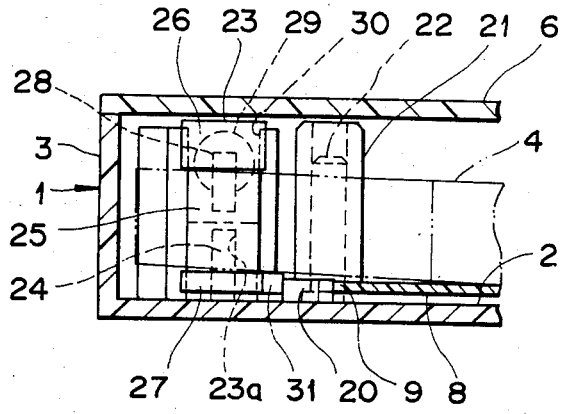
FIG. 3 is an enlarged front elevational cross sectional view taken along a cassette body, the lid member and a flange, illustrating the ribbon lock control member in an operative position and the locking member in a locking position.

The opening at the top of the cassette body 1 is closed with a lid member 6 (FIG. 3) made of a synthetic resin material. A cylindrical support shaft 7 having a partially cutaway circular cross section is erected in integral relationship on an upper face of the bottom plate 2.

A flange 8 made of a synthetic resin material is in the form of a disk having serrations 9 formed in a fine pitch along an outer periphery thereof and has a hub 10 of a circular cross section erected in integral relationship at the center of an upper face thereof. The flange hub 10 is opened at the top and bottom thereof and is fitted for rotation around the support shaft 7 so as to support the flange 8 for rotation just above the bottom plate 2.

The print ribbon 4 is wound around a feed spool 11 which is fitted around the flange hub 10 and is placed on the top face of the flange 8. A beginning end of the ribbon 4 is securely fixed to a take-up spool 12 located at a suitable position above the bottom plate 2, and the ribbon 4 extends from the feed spool 11 to the take-up spool 12 under the guidance of the guide portions **5*a* and 5*b* while a portion 4*a* of the ribbon 4 of a predetermined length for use in printing between the guide portions 5*a* and 5*b* is exposed in taut condition outside the cassette body 1 (FIG. 1**).

The take-up spool 12 is received for rotation in and for movement along a guide slot 14 of a bracket 13 mounted on the bottom plate 2, and a spring 16 urges the take-up spool 12 so that an outer circumferential portion of the used ribbon wound on the take-up spool 12 may be normally engaged with a spike gear or toothed roller 15 which is supported for rotation on the bottom plate 2.

Figure 1:
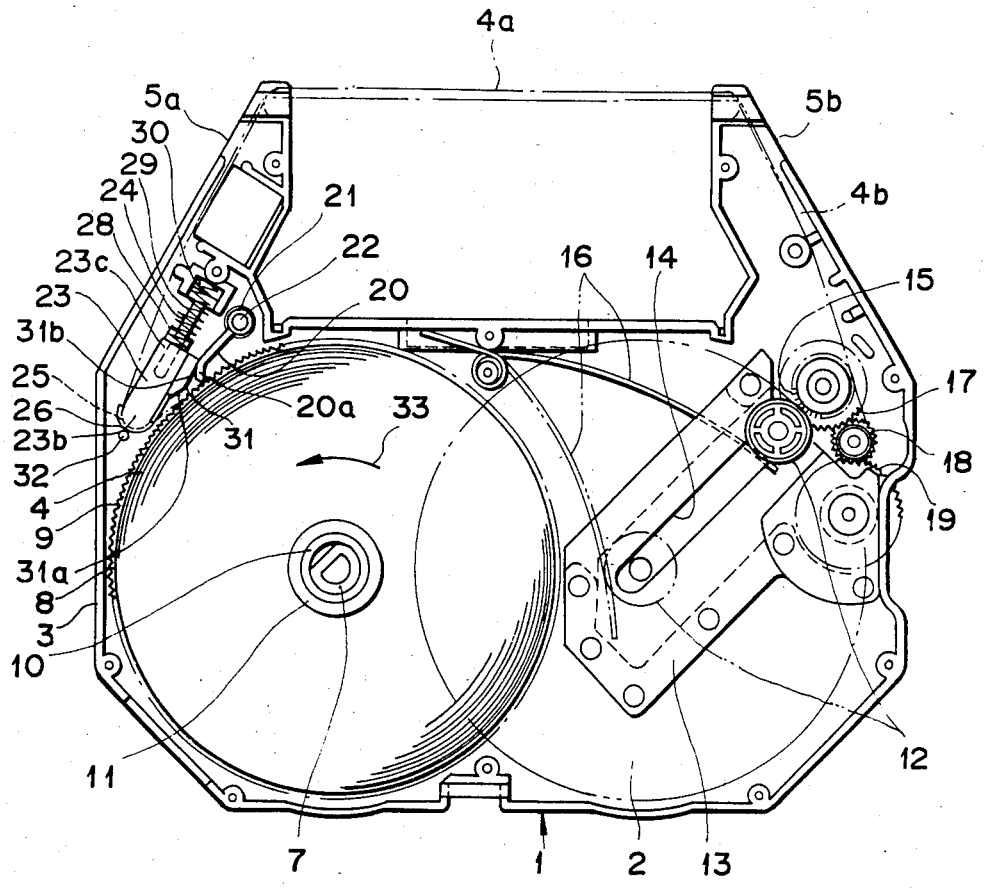
FIG. 1 is a plan view of a print ribbon cassette embodying the present invention with a lid member removed.

The spike gear 15 can be connected, in a well known manner as in a conventional print ribbon cassette, to a driving shaft (not shown) of a ribbon feed drive mechanism (not shown) of a typewriter or printer via gears 17, 18 and 19 supported for rotation on the bottom plate 2 so that the spike gear 15 may be rotated in a clockwise direction in FIG. 1 by the gears 17, 18, and 19 to thus rotate the take-up spool 12 in a counterclockwise direction to wind a used portion **4*b* of the ribbon 4 onto the take-up spool 12**.

A lock member 20 made of a synthetic resin material is in the form of an elongated plate having an obliquely bent extension **20*a* at an end thereof and has a bearing cylinder or hub 21 of a circular cross section formed at the other base end thereof. The hub 21 of the lock member 20 is fitted for rotation around a pivot 22 erected on a corner portion of the guide portion 5***a* of the bottom plate 2 adjacent the flange 8. Thus, the lock member 20 is movable between a locking position (FIG. 1) in which a tip end of the extension 20*a* of the lock member 20 engages with the peripheral serrations 9 on the flange 8 to prevent rotation of the flange 8 and hence of the feed spool 11 in an unwinding direction, that is, in a direction to unwind the ribbon 4 therefrom and an unlocking or lock release position (FIG. 2) in which the flange 8 disengages or is free from the lock member 20 to allow rotation of the feed spool 11 to feed the ribbon 4.

A ribbon lock control member 23 substantially in the form of a rectangular parallelepiped is made of a synthetic resin material and has an elongated groove 23*a* formed to downwardly open at a bottom face thereof. A support rib 24 in the form of an elongated wall is formed to extend from the bottom plate 2 and is located between the lock member 20 and the side wall 3. The support rib 24 is fitted in the groove 23*a* of the ribbon lock control member 23 so as to support the ribbon lock control member 23 for movement therealong.

The ribbon lock control member 23 has a ribbon guide face 25 formed substantially at the center of a lower portion of an end 23*b* thereof which has a semicircular shape in plan and a pair of projections 26 and 27 formed contiguously above and below the ribbon guide face 25 so as to guide the ribbon 4 therebetween. The ribbon lock control member 23 has another projection 28 formed to extend from a rear end 23*c* thereof, and an end of a spring member 29 is securely fixed to the projection 28 of the ribbon lock control member 23 while the other end thereof is received in a spring receiver 30 formed in contiguous relationship to the support rib 24 such that the spring member 29 may normally urge the ribbon lock control member 23 to a forward operative position as seen in FIG. 1.

The ribbon lock control member 23 has an engaging camming portion 31 of a substantially distorted trapezoidal shape in plan formed to extend from a lower portion of a side thereof opposing to the lock member 20. The engaging camming portion 31 of the ribbon lock control member 23 has a forward oblique face 31*a* and a rearward straight face 31*b* contiguous to the oblique face 31*a*, and the ribbon lock control member 23 is movable between the operative position (FIG. 1) in which the straight face 31*b* of the engaging portion 31 thereof engages with a portion of the lock member 20 on a rear side of the bent extension 20*a* to position the lock member 20 to the locking position and an inoperative position (FIG. 2) in which the straight face 31*b* of the engaging portion 31 is out of engagement with the bent extension 20*a* of the lock member 20 to allow the latter to move to its unlocking position. Thus, the ribbon lock control member 23 can be moved forwardly to the operative position by the spring member 29, and can be moved rearwardly to the inoperative position against the urging of the spring member 29.

Meanwhile, once the ribbon 4 wound on the feed spool 11 on the flange 8 is fed therefrom, it is at first guided by the ribbon guide face 25 of the ribbon lock control member 23 and is then directed reversely thereby toward the guide portion 5*a* in the rear thereof. The ribbon lock control member 23, however, is normally urged by the spring member 29 to the operative position in which the projections 26 and 27 at the end thereof are abutted with a stopper pin 32 which is erected on the bottom plate 2.

Figure 2:
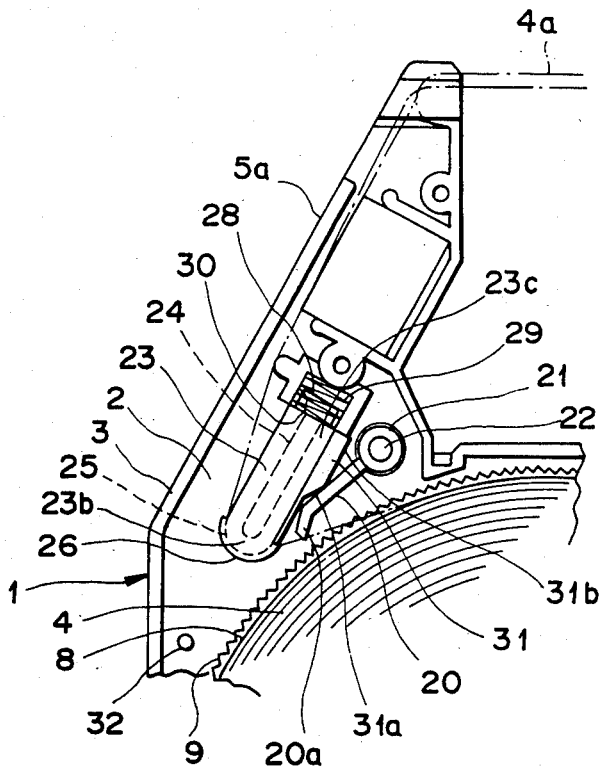
FIG. 2 is an enlarged plan view illustrating a ribbon lock controlling member in an inoperative position and a locking member in an unlocking position.

However, when the ribbon lock control member 23 is in the operative position and hence the lock member 20 is in the locking position and the exposed portion 4*a* of the ribbon 4 is in taut condition, if the ribbon feed drive mechanism not shown is operated, then the used portion 4*b* of the ribbon 4 will be wound onto the take-up spool 12 so that a tensile force greater than the urging force of the spring member 29 may be produced on the ribbon 4 to press and move the ribbon lock control member 23 rearwardly to the inoperative position of FIG. 2 against the urging of the spring member 29.

As the ribbon lock control member 23 is thus moved to the inoperative position, the bent extension 20*a* of the lock member 20 is disengaged from the straight face 31*b* and now engaged with the oblique face 31*a* of the ribbon lock control member 23, removing the pressing force of the lock member 20 toward the flange 8. Accordingly, the lock member 20 can now move freely to the unlocking position to permit rotation of the feed spool 11 in a direction of an arrow mark 33 to feed an unused portion of the ribbon 4 (FIG. 2).

On the other hand, if the ribbon feed drive mechanism stops its operation to stop feeding of the ribbon 4 or if inadvertent slackening of the ribbon 4 should occur during printing operation until the tensile force of the ribbon 4 becomes lower than the urging force of the spring member 29 or worse becomes ineffective, then the ribbon lock control member 23 is moved to the operative position by the urging of the spring member 29 accompanied by the ribbon 4 while the lock member 20 is restored to the locking position.

As a result, rotation of the feed spool 11 is stopped to stop feeding of the ribbon 4 while the used portion 4*b* of the ribbon 4 is wound onto the take-up spool 12, eliminating slackening of the ribbon 4 until a sufficient tensile force to hold the portion 4*a* of the ribbon 4 between the feed and take-up spools 11 and 12 in taut condition may be applied to the ribbon 4 again.

As apparent from the foregoing description, according to the present invention, a ribbon lock control member and a lock member are caused to cooperate with each other by a balance between an urging force of the ribbon lock control member by a spring member and a tensile force of a ribbon to automatically control feeding of the ribbon to hold the ribbon in taut condition. Accordingly, a print ribbon cassette is prevented from suffering problems in printing operations caused by slackening appearing at a portion of the ribbon for printing. Besides, since a ribbon lock device has a simplified construction with a ribbon lock control member and a lock member, it can be constructed from a reduced number of components comparing with a conventional ribbon lock device and requires a reduced time for assembly thereof, allowing production thereof at a reduced cost.

What is claimed is:

1. A print ribbon cassette removably mountable on a printing office machine, comprising:

a cassette body including a bottom member;

a feed spool mounted for rotation in said cassette body and having a ribbon wound thereon;

a take-up spool mounted for rotation in said cassette body for winding the ribbon thereon;

ribbon guide means provided on said cassette body for guiding the ribbon to be fed from said feed spool to said take-up spool; and ribbon locking means for permitting rotation of said feed spool to feed the ribbon therefrom during use of the ribbon and for preventing inadvertent rotation of said feed spool during disuse of the ribbon;

said ribbon locking means including a flange mounted for coaxial and integrally rotatable relationship with said feed spool and having peripheral serrations formed thereon; a lock member mounted for pivotal motion on said cassette body and having a tip end for engagement with said peripheral serrations of said flange, a ribbon lock control member movable in response to a tensile force of the ribbon fed out from said feed spool between an operative position in which said ribbon lock control member engages with a portion adjacent said tip end of said lock member to press said lock member into engagement with said flange and an inoperative position in which said ribbon lock control member disengages from said lock member to allow said lock member to be disengaged from said flange, and a spring member for urging said ribbon lock control member to said operative position;

said bottom member having a support rib provided thereon and said ribbon lock control member having a groove formed on a bottom face thereof and fitted with said support rib to allow said ribbon lock control member to move back and forth along said support rib, said ribbon lock control member having a ribbon guide face formed at a forward end thereof, said ribbon lock control member having at the opposite rearward end thereof a receiving portion for receiving said spring member thereon.

2. A print ribbon cassette according to claim 1, wherein said ribbon guide means includes a pair of guide elements integral with said bottom member and extending from opposite corners of said cassette body, and a toothed roller and a plurality of gears mounted for rotation on said bottom member.

3. A print ribbon cassette according to claim 1, wherein said lock member is located independently of and adjacent said flange for engagement with said ribbon lock control member.

4. A print ribbon cassette removably mountable on a printing office machine, comprising:

a cassette body including a bottom member;

a feed spool mounted for rotation in said cassette body and having a ribbon wound thereon;

a take-up spool mounted for rotation in said cassette body for winding the ribbon thereon;

ribbon guide means provided on said cassette body for guiding the ribbon to be fed from said feed spool to said take-up spool; and ribbon locking means for permitting rotation of said feed spool to feed the ribbon therefrom during use of the ribbon and for preventing inadvertent rotation of said feed spool during disuse of the ribbon;

said ribbon locking means including a flange mounted for coaxial and integrally rotatable relationship with said feed spool and having peripheral serrations formed thereon, a lock member mounted for pivotal motion on said cassette body and having a tip end for engagement with said peripheral serrations of said flange, a ribbon lock control member movable in response to a tensile force of the ribbon fed out from said feed spool between an operative position in which said ribbon lock control member engages with a portion adjacent said tip end of said lock member to press said lock member into engagement with said flange and an inopertive position in which said ribbon lock control member disengages from said lock member to allow said lock member to be disengaged from said flange, and a spring member for urging said ribbon lock control member to said operative position;

said lock member being located independently of and adjacent said flange for engagement with said ribbon lock control member, said ribbon lock control member having a camming means provided at a side thereof facing said lock member, said camming means including an oblique portion and a straight portion contiguous to said oblique portion.

5. A print ribbon cassette according to claim 4 wherein said lock member is an elongated plate which is obliquely bent adjacent said end thereof, said lock member having at the opposite end thereof a hub which is fitted around a pivot located on said bottom member to allow pivotal motion of said lock member therearound.

6. A print ribbon cassette according to claim 4, wherein said lock member engages at a back of a portion adjacent said tip end thereof with said camming means of said ribbon lock control member.

7. A print ribbon cassette according to claim 4, wherein said operative position of said ribbon lock control member is a position in which said straight portion of said ribbon lock control member engages with said portion of said lock member, and said inoperative position is a position in which said portion of said lock member disengages from said straight portion of said ribbon lock control member.

8. A print ribbon cassette according to claim 7, wherein said lock member is pressed to engage said tip end thereof with said serrations of said flange to lock said flange when said portion adjacent said tip end of said lock member engages with said straight portion of said ribbon lock control member, and said lock member is brought out of pressing engagement with said flange to release said flange when said lock member is disengaged from said straight portion and engaged with said oblique portion of said ribbon lock control member.

* * * * *